US012398577B2

(12) United States Patent
Tillman-Davis

(10) Patent No.: US 12,398,577 B2
(45) Date of Patent: Aug. 26, 2025

(54) RAPID RELEASE ROOFTOP TENT MOUNT

(71) Applicant: Michael William Tillman-Davis, Decatur, GA (US)

(72) Inventor: Michael William Tillman-Davis, Decatur, GA (US)

( * ) Notice: Subject to any disclaimer, the term of this patent is extended or adjusted under 35 U.S.C. 154(b) by 571 days.

(21) Appl. No.: 17/810,494

(22) Filed: Jul. 1, 2022

(65) Prior Publication Data

US 2024/0003160 A1 Jan. 4, 2024

(51) Int. Cl.
*E04H 15/06* (2006.01)

(52) U.S. Cl.
CPC ..... *E04H 15/06* (2013.01); *Y10T 403/46* (2015.01)

(58) Field of Classification Search
CPC ..... E04H 15/06; B60J 7/102
USPC ..... 135/144, 88.09, 88.19
See application file for complete search history.

(56) References Cited

U.S. PATENT DOCUMENTS 1,751,518 A * 3/1930 Maclean ..... E04H 15/06 135/147
2,770,244 A * 11/1956 Carson ..... E04H 15/06 135/88.13
2,825,351 A * 3/1958 Thornton ..... E04H 15/06 135/904
2,828,035 A * 3/1958 Kuchinskie ..... B60R 9/042 414/462
3,192,937 A * 7/1965 Carter ..... E04H 15/06 135/904
3,228,406 A * 1/1966 Jamba ..... E04H 15/06 135/904
3,289,684 A * 12/1966 Lowe ..... E04H 15/06 296/159
5,769,482 A * 6/1998 Kirk ..... B60J 7/102 296/105
5,988,195 A * 11/1999 Kaestner ..... E04H 15/06 135/88.13
6,192,909 B1 * 2/2001 Strausser ..... E04H 15/40 5/113
7,162,968 B2 * 1/2007 Thompson ..... B63B 17/02 114/361
2007/0209693 A1 * 9/2007 Banfill ..... E04H 15/06 135/88.08
2017/0349080 A1 * 12/2017 Sautter ..... B60P 3/34
2021/0370751 A1 * 12/2021 Schafer, Jr. ..... B60J 7/102

* cited by examiner

*Primary Examiner* — Daniel J Wiley
(74) *Attorney, Agent, or Firm* — Gurr & Brande, PLLC; Robert A. Gurr

(57) ABSTRACT

A bottom bracket made with a box at its center and a flange on opposing sides. Over each flange, on the side of the box, are two equal, opposing through-holes. Each flange is drilled with holes to allow the bracket to be bolted to a roof rack rail. A top bracket made in a box shape with an open bottom to fit over the box-shaped bottom bracket and with the top of the top bracket fabricated to accept two bolts that will screw into an adapter fitted into a rail slot on the underside of a roof-top tent. The top bracket also has two opposing through-holes matching the through-holes on the sides of the bottom bracket. The top and bottom brackets held together by a locking quick-release pin inserted through the through-hole on the sides of the top and bottom brackets.

1 Claim, 2 Drawing Sheets

RAPID RELEASE ROOFTOP TENT MOUNT

CROSS-REFERENCE TO RELATED APPLICATIONS

N/A

BACKGROUND

The inspiration for this invention is to create a rapid-release method to affix a rooftop tent to a vehicle roof-rack and to quickly and easily remove the rooftop tent from the vehicle roof-rack. The space between the bottom of the rooftop tent and the vehicle roof rack is very small . . . no more than 6 inches. Generally a person must use up to eight (8) nuts and bolts to secure a rooftop tent to a vehicle roof rack. This requires several hours pushing ones arms into a cramped, metal space to affix the nuts to the bolts and then several hours uninstalling the nuts and bolts leading to lost time and leaving arms with bruises and abrasions.

SUMMARY OF THE INVENTION

This invention solves the problem of the extensive time and energy lost securing nuts and bolts in the cramped, hard-to-access space between the bottom of a rooftop tent and the top of a vehicle. This invention consists of three parts: part one bolts to a vehicle roof-rack, part two bolts to the underside of a rooftop tent, and part three fits through opposing holes in the sides of the parts one and two after part two has been lowered onto part one. The insertion of part three locks in place parts one and two thereby securing the rooftop tent to the vehicle roof-rack. The present invention allows the user to insert one piece of locking hardware to secure their rooftop tent to their roof-rack and then to remove that same piece of locking hardware to remove their rooftop tent from their roof-rack.

DETAILED DESCRIPTION OF THE INVENTION

The purpose of this invention is to serve as a rapid-release/quick-release mount for a rooftop tent.

People wanting to secure a rooftop tent to a vehicle roof-rack have limited options. The most frequently used option is to bolt the rooftop tent to the rack. The following legend provides a numerical guide to the relevant parts of the rooftop tent mount apparatus 100: bottom bracket 102; top bracket 104; locking quick-release pin 106; flanges 108A-B of the bottom bracket 102; opposing holes 110A-B drilled in the sides of the bottom bracket 102 and opposing holes 112A-B in the sides of the top bracket 104 where the locking quick-release pin 106 is inserted; holes 114A-D to bolt bottom bracket 102 to a roof-rack rail; and holes 116A-B to bolt top bracket 104 to an underside of a rooftop tent.

Figure 1:
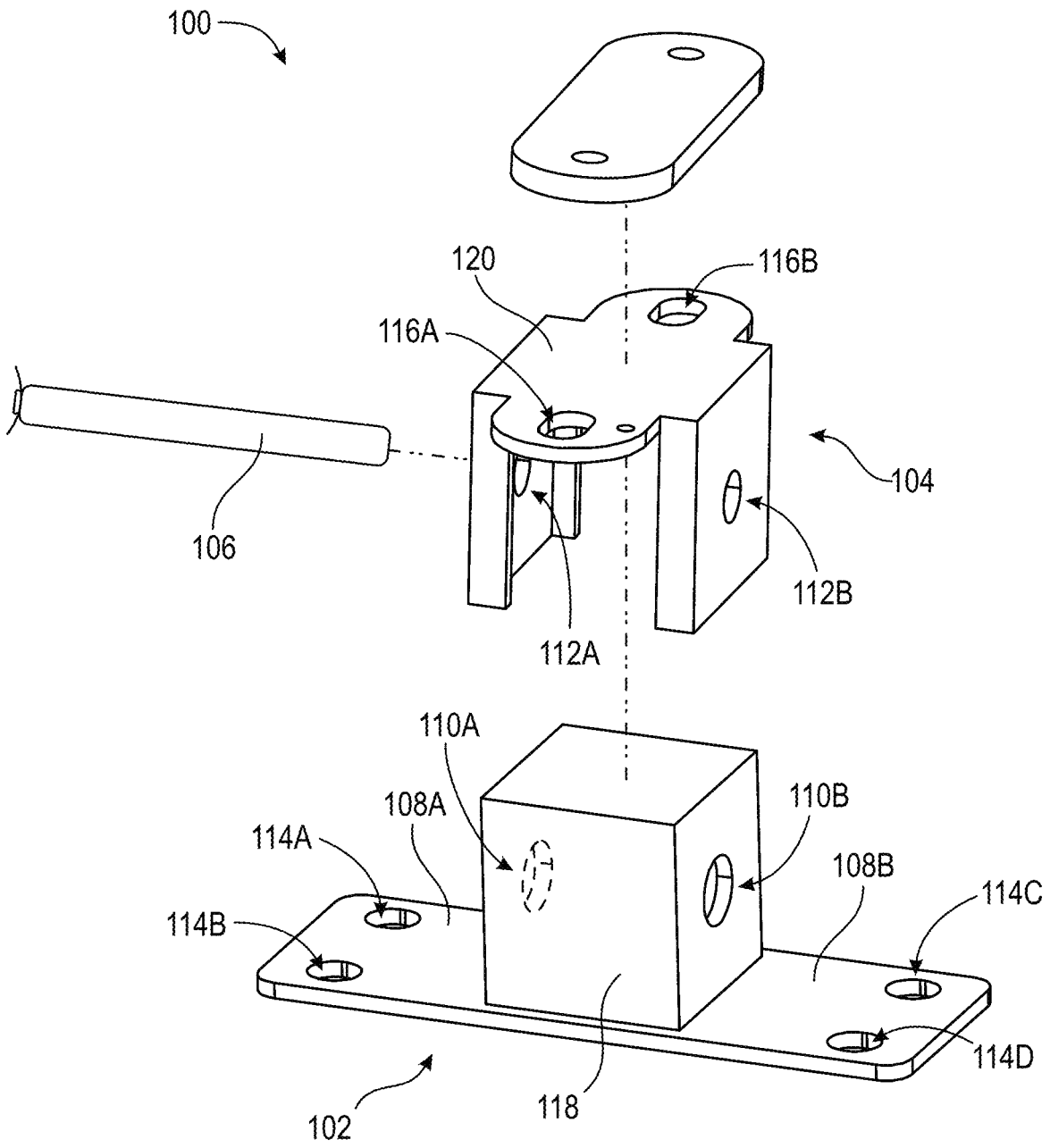
FIG. 1 illustrates a front perspective view of rooftop tent mount apparatus in a disassembled configuration.
Figure 2:
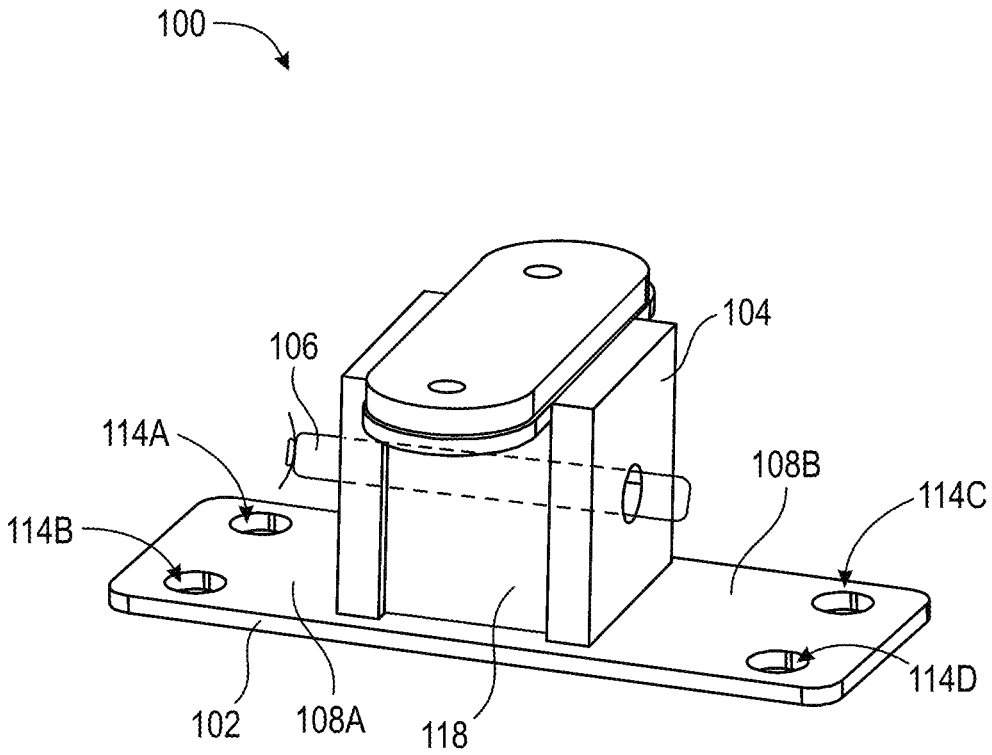
FIG. 2 illustrates a front perspective view of a rooftop tent mount apparatus in an assembled configuration.

FIG. 1 shows the bottom bracket 102, top bracket 104, and locking quick-release pin 106 unassembled as seen from the front or back, being mirror images of each other. FIG. 2 shows the top bracket 104 and bottom bracket 102 and locking quick-release pin 106 assembled as seen from the front or back, being mirror images of each other.

The rapid-release rooftop tent mount apparatus disclosed herein employs a locking quick-release pin 106 to secure a flanged bottom bracket 102 to a top bracket 104 on the underside of the rooftop tent. The flanged bottom bracket 102 consists of fabricated steel formed into the shape of a box 118 one to two inches high, by one to two inches wide by one to two inches long. The flanges 108A-B are on opposite sides of the box 118 with each flange 108A-B having two holes 114A-B, 114C-D, respectively, so that the bracket 102 may be bolted to the roof-rack. The box 118 atop and between the flanges 108A-B has an equal and opposing hole 110A-B each on opposite sides of the box 118 and above the flanges 108A-B, respectively. The top bracket 104 is to be bolted to the underside of the rooftop tent. The top bracket 104 is meant to fit over the bottom bracket 102. The top bracket 104 also consists of fabricated steel but formed into the shape of a lower-case letter "n" with a flat, as opposed to round, top. The underside of the top bracket 104 is left open to fit over the box 118 of the bottom bracket 102. The top, flat portion 120 of the top bracket 104 has two holes 116A-B that are used to bolt the top bracket 104 to the underside of the rooftop tent. The top bracket 104 is similarly one to two inches high, by one to two inches wide by one to two inches long and has holes 112A-B in the side that match the size and location of the side-cut holes 110A-B on the bottom bracket 102.

Once the top bracket 104 is secured to the underside of the rooftop tent the apparatus can be lowered on top of the bottom bracket 102 that is bolted to the roof-rack. Where the holes line up on the bottom bracket 102 and top bracket 104, in other words, hole 112A of the top bracket 104 aligns with hole 110A of the bottom bracket 102 and hole 112B of the top bracket 104 aligns with hole 110B of the bottom bracket 102, a locking quick-release pin 106 is inserted, as shown in FIG. 2, to hold the bottom bracket 102 and top bracket 104 together and thereby mount the rooftop tent on the roof-rack.

What is claimed is:

1. A rooftop tent mount apparatus, comprising:

a bottom bracket configured to secure to a roof-rack of a vehicle, the bottom bracket, comprising:

a first, horizontal portion forming a first flange and a second flange, the first flange comprising a plurality of first holes and the second flange comprising a plurality of second holes, the plurality of first and second holes configured to secure the bottom bracket to the roof-rack rail of the vehicle, a box extending vertically upward from the first, horizontal portion and interposed between the plurality of first holes and the plurality of second holes of the first and second flanges, respectively, the box comprising a first wall having a first hole and a second wall having a second, opposing hole;

a top bracket, comprising a first, horizontal portion having a first hole on a first end and a second hole on a second end, a second, vertical portion extending downwardly from the first, horizontal portion and interposed between the first and second holes of the first, horizontal portion, the second, vertical portion comprising a first wall having a first hole and a second wall having a second, opposing hole; and a locking pin;

wherein the second, vertical portion of the top bracket is configured to slide over and couple to the box of the bottom bracket, the first hole of the first wall of the second, vertical portion of the top bracket aligning with the first hole of the first wall of the box of the bottom bracket, and the second hole of the second wall of the second, vertical portion of the top bracket aligning with the second hole of the second wall of the box of the bottom bracket;

wherein when the top bracket is coupled to the bottom bracket, the locking pin is configured to slide through the first hole of the of the first wall of the second, vertical portion of the top bracket, through the first hole of the first wall of the box of the bottom bracket, through the second hole of the second wall of the box of the bottom bracket, and through the second hole of the second wall of the second, vertical portion of the top bracket, thereby preventing separation of the top bracket from the bottom bracket; and wherein when the top bracket is coupled to the bottom bracket, the first, horizontal portion of the top bracket is perpendicular to the first, horizontal portion of the bottom bracket.

* * * * *